US009004412B2

(12) United States Patent
Brown

(10) Patent No.: US 9,004,412 B2
(45) Date of Patent: Apr. 14, 2015

(54) RAIL COLLISION THREAT DETECTION SYSTEM

(75) Inventor: Dale Alexander Brown, LaGrange, IL (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 260 days.

(21) Appl. No.: 13/547,613

(22) Filed: Jul. 12, 2012

(65) Prior Publication Data

US 2014/0014784 A1 Jan. 16, 2014

(51) Int. Cl.

| | |
|---|---|
| ***B61L 25/04*** | (2006.01) |
| ***B61L 23/34*** | (2006.01) |
| ***G05D 1/00*** | (2006.01) |
| ***B61L 15/00*** | (2006.01) |

(52) U.S. Cl.

CPC ..... *B61L 15/0027* (2013.01); *B61L 15/0054* (2013.01); *B61L 23/34* (2013.01)

(58) Field of Classification Search

USPC .... 246/2 E, 2 F, 2 S, 14, 15, 122 R, 124, 177, 246/182 B, 182 C; 701/19, 20

See application file for complete search history.

(56) References Cited

U.S. PATENT DOCUMENTS

| | | | | |
|---|---|---|---|---|
| 6,978,195 | B2 * | 12/2005 | Kane et al. | 701/19 |
| 7,222,003 | B2 | 5/2007 | Stull et al. | |
| 7,742,850 | B2 | 6/2010 | Kane et al. | |
| 2008/0243320 | A1 | 10/2008 | Otsubo et al. | |
| 2010/0253548 | A1 | 10/2010 | Kane et al. | |

* cited by examiner

*Primary Examiner* — R. J. McCarry, Jr.

(74) *Attorney, Agent, or Firm* — Finnegan, Henderson, Farabow, Garrett & Dunner, LLP

(57) ABSTRACT

A detection system may include a transmitter associated with a first train configured to emit an end-of-train signal. The detection system may include a receiver associated with the transmitter and configured to receive the end-of-train signal from the transmitter. The receiver may also be configured to receive at least one remote signal from a second train and determine whether the second train is a collision threat based on the remote signal from the second train.

18 Claims, 3 Drawing Sheets

RAIL COLLISION THREAT DETECTION SYSTEM

TECHNICAL FIELD

This disclosure relates generally to a collision threat detection system and, more specifically, to a rail collision threat detection system that utilizes end-of-train (EOT) technology to identify possible threats.

BACKGROUND

As safety concerns for rail systems become an increasingly important public issue, a need has arisen for implementing positive train control (PTC), which incorporates equipment onboard (and offboard) trains for train collision avoidance and line speed enforcement. As trains move at high speeds, it may be important to detect potential collisions well in advance, so that trains can be slowed down to prevent collisions. These systems may use technology to identify other trains on the rail system as well as their relative speeds for collision prevention. However, proposed PTC systems may require substantial infrastructure changes, and the estimated multi-billion dollar infrastructure costs may pose a serious obstacle for implementing PTC.

One system for implementing PTC is described in U.S. Pat. No. 7,222,003 B2 ("the '003 patent"). The '003 patent is directed to a method and computer program product for monitoring the integrity of a railroad train and determining passage of the train relative to a plurality of virtual blocks defined by wireless transmissions along a section of track over which the train travels. The virtual blocks provide safeguards for the travel of the train relative to other trains on the section of the track when there is a shared use of the section of track.

The system provided by the '003 patent is subject to a number of possible drawbacks. For example, this system includes a centralized traffic control system that a train must communicate with to determine the presence or absence of a virtual block. Furthermore, this system monitors virtual blocks, which are defined portions of the railway. Such a system may be unduly complex for determining a potential collision threat and may require monitoring of the relative location of the locomotive to potential threats as well as those locations relative to the location of the virtual block. Thus, a less complex collision threat detection system may be desired.

The presently disclosed systems and methods are directed to overcoming one or more of the problems set forth above and/or other problems in the art.

SUMMARY

According to one aspect, the disclosure is directed to a detection system including a transmitter associated with a first train and configured to emit an end-of-train signal. The detection system may include a receiver associated with the transmitter and configured to receive the end-of-train signal from the transmitter. The receiver may also be configured to receive at least one remote signal from a second train and determine whether the second train is a collision threat to the first train based on the remote signal from the second train.

In accordance with another aspect, the disclosure is directed to a method for detecting a collision threat between a first train and a second train. The method may include receiving on the first train a signal from the second train and detecting a signal strength of the signal. The method may also include determining a relative distance between the first train and the second train based on the signal strength. The method may include identifying whether the second train is a collision threat to the first train based on the relative distance.

According to another aspect, the disclosure is directed to a first train. The first train may include a locomotive and a transmitter associated with at least one of the locomotive and a trailing railcar and configured to emit an end-of train signal and a receiver associated with the locomotive. The receiver may be configured to receive the end-of-train signal from the transmitter and receive a remote signal from a second train. The receiver may also be configured to determine whether the second train poses a collision threat to the first train based on the remote signal.

DETAILED DESCRIPTION

Figure 1:
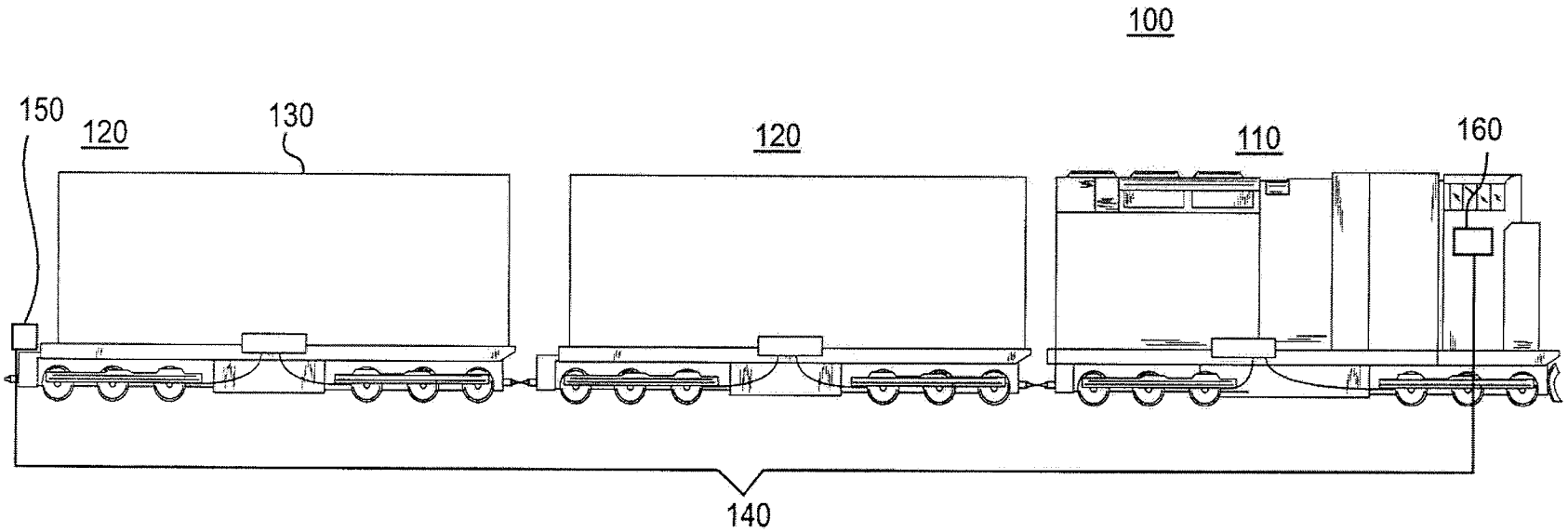
FIG. 1 shows an exemplary train including an exemplary embodiment of a detection system

FIG. 1 illustrates an exemplary embodiment of a train 100 in which systems and methods for collision threat detection may be implemented consistent with the disclosed embodiments. Train 100 may include a locomotive 110 and at least one trailing railcar 120 connected to locomotive 110 to form train 100. The at least one trailing railcar 120 may include a last railcar 130, which may be trailing railcar 120 located at the opposite end of train 100 from locomotive 110. Trailing railcars 120 may include any type of railcar, such as, for example, passenger cars, flatcars, other locomotives, or freight cars. Furthermore, trailing railcars 120 may be self-propelled or passive cars.

Train 100 may include a detection system 140 configured to locate other trains and/or potential obstacles within the path of train 100. Detection system 140 may incorporate devices and methods already used as part of the EOT technology of train 100.

Current EOT technology uses different types of communication systems, such as a transmitter located on the last railcar and a receiver located on the lead locomotive, where the receiver is configured to receive signals from the transmitter to determine whether the EOT is operating properly. For example, detection system 140 may include a transmitter 150 associated with train 100, such as, for example, a transmitter associated with last railcar 130. Detection system 140 may also include a receiver 160 that may be associated with locomotive 110.

Figure 2:
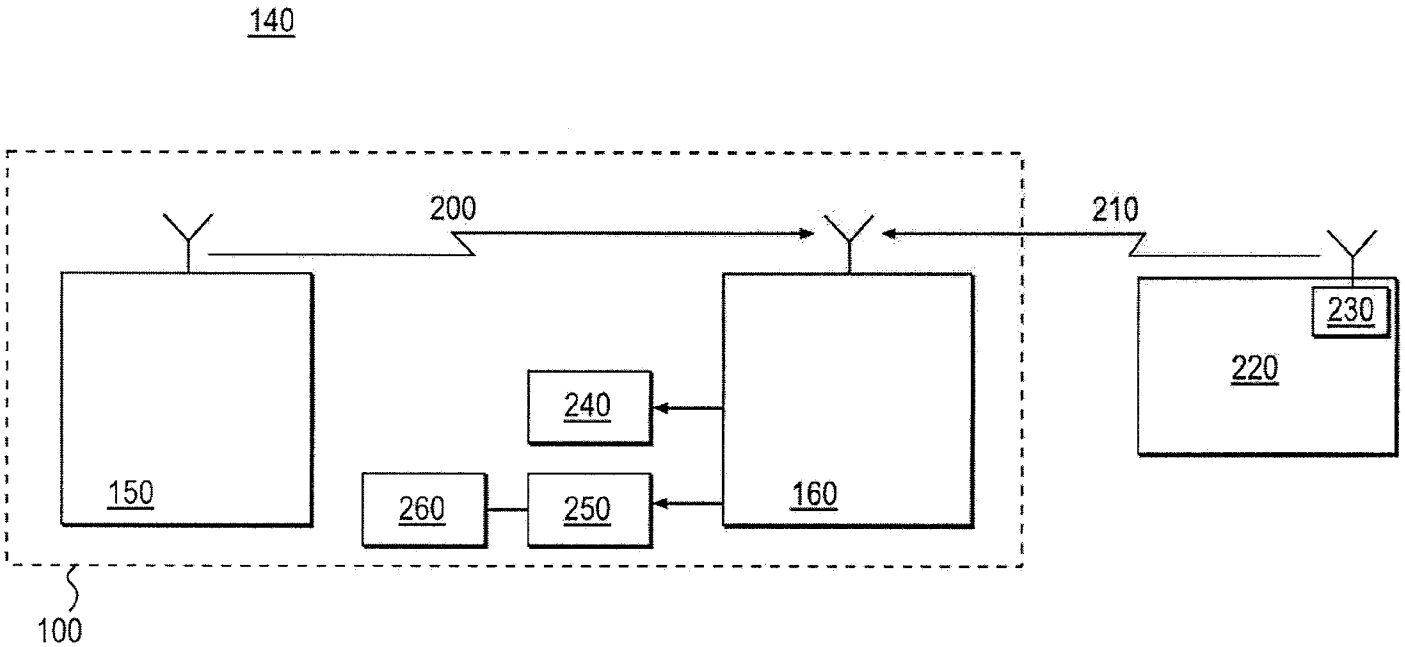
FIG. 2 is a block diagram of an exemplary embodiment of a detection system.

FIG. 2 illustrates an exemplary block diagram of detection system 140. Transmitter 150 may embody a single microprocessor or multiple microprocessors that include a means for sending an EOT signal 200 to receiver 160 that may be indicative of operating conditions of train 100 and/or last railcar 130. For example, transmitter 150 may encode brake pipe pressure, EOT battery status, and/or direction of motion. Additionally or alternatively, EOT transmitter 150 may include a serial code indicative of the identity of train 100 in EOT signal 200.

Numerous commercially available microprocessors may be configured to perform the functions of transmitter 150. It should be appreciated that transmitter 150 could readily embody a general microprocessor capable of controlling numerous machine or engine functions. Transmitter 150 may include all the components required to run an application such as, for example, a memory, a secondary storage device, and a processor, such as a central processing unit or any other means known. Various other known circuits may be associated with transmitter 150, including power source circuitry (not shown) and other appropriate circuitry.

In a similar manner, receiver 160 may embody a single microprocessor or multiple microprocessors that include a means for receiving signals, such as, for example, from transmitter 150 and, optionally, a means for sending signals. Numerous commercially available microprocessors may be configured to perform the functions of receiver 160. It should be appreciated that receiver 160 could readily embody a general microprocessor capable of controlling numerous machine or engine functions. Receiver 160 may include all the components required to run an application such as, for example, a memory, a secondary storage device, and a processor, such as a central processing unit or any other means known. Various other known circuits may be associated with receiver 160, including power source circuitry (not shown) and other appropriate circuitry.

Receiver 160 may be configured for communication at frequencies at which it receives signals from transmitter 150 and/or signals from a second train 220. For example, receiver 160 may be configured for communication at frequencies of 161.114 MHz and/or 457.9635 MHz. These frequencies are assigned by the FCC to the American Association of Railroads and Northern Sulfolk, respectively, for EOT transmissions. Receiver 160 may be configured to receive an EOT signal 200 from transmitter 150. Receiver 160 may also be configured to receive a remote signal 210 from second train 220. For example, remote signal 210 may comprise an EOT signal from a second transmitter 230 associated with second train 220. According to some embodiments, remote signal 210 may include a track identifier that indicates on which track second train 220 is traveling.

Based on remote signal 210, receiver 160 may be configured to determine whether second train 220 poses a collision threat to train 100. For example, receiver 160 may be configured to identify second train 220 as a collision threat if train 220 is within a certain distance from train 100. Optionally, receiver 160 may consider other factors, such as, for example, the track on which second train 220 travels, the speed of second train 220, and the direction of travel of second train 220. According to some embodiments, receiver 160 may be configured to analyze and/or process remote signal 210 to determine whether second train 220 poses a collision threat.

According to some embodiments, receiver 160 may consider the track on which second train 220 travels in determining whether second train 220 is a collision threat. For example, receiver 160 may extract the track identification information from remote signal 210 and use this information to determine whether second train 220 is a collision threat. Receiver 160 may also store or receive a signal from transmitter 150 indicative of the track on which train 100 travels. According to some embodiments, receiver 160 may compare the track identifier from second transmitter 230 with track information corresponding to train 100 and determine that second train 220 is not a collision threat if train 100 and second train 220 are traveling on different, non-intersecting tracks.

Receiver 160 may be configured to derive information from remote signal 210 useful in determining whether second train 220 is a collision threat. According to some embodiments, receiver 160 may be configured to determine the relative distance between train 100 and second train 220 based on remote signal 210. For example, receiver 160 may detect a signal strength of remote signal 210 and, based on the signal strength, determine an approximate relative distance between train 100 and second train 220. For example, receiver 160 may use a lookup table and/or an algorithm to determine the distance based on signal strength, as there is a known relationship between signal strength and distance between the signal source (e.g., second transmitter 230) and receiver 160. According to some embodiments, the relative distance may be an approximation that factors a margin of error into the determination. For example, other factors besides distance of travel can decrease the signal strength. Additionally, as it may take a mile for a moving train 100 to come to a complete stop, relative distance may be approximated within a few hundred yards without affecting the integrity of detection system 140. The margin-of-error may be adapted to suit the particular needs of train 100. For example, in some embodiments, a determined relative distance with a margin-of-error of 300 yards may be satisfactory for the protection of train 100.

According to some embodiments, receiver 160 may also be configured to determine, based on the relative distance between train 100 and second train 220, whether second train 220 is within a warning range of receiver 160. A warning range may be a value set by an operator or a dispatch and stored in the memory for receiver 160. According to some embodiments, all second trains 220 that are outside of the warning range may be designated as non-threats. For example, receiver 160 may ignore remote signals 210 that are determined to be outside the warning range. This determination could be made, for example, based on the signal strength of remote signal 210.

According to some embodiments, if second train 220 is within the warning range, receiver 160 may be configured to identify whether second train 220 is a collision threat based on the relative distance and the speed of second train 220. For example, if second train 220 is traveling behind train 100 in the same direction as train 100 and the speed of second train 220 is less than that of train 100, then receiver 160 may determine second train 220 is not a collision threat.

According to some embodiments, detection system 140 may include additional systems associated with responding to a perceived collision threat. For example, detection system 140 may include a warning system 240 configured to provide a notification of the collision threat. For example, warning system 240 may send a signal to the operator of train 100. Additionally or alternatively, warning system 240 may also send a warning signal to the dispatch. According to some embodiments, warning system 240 may include a communications link between detection system 140 and train operator and/or dispatch.

According to some embodiments, detection system 140 may include a braking controller 250. Braking controller 250 may embody a single microprocessor or multiple microprocessors that include a means for receiving signals, such as, for example, from receiver 160 and a train operator and, optionally, a means for controlling a braking system 260 associated with train 100. Numerous commercially available microprocessors can be configured to perform the functions of braking controller 250. It should be appreciated that braking controller 250 could readily embody a general machine or communication microprocessor capable of controlling numerous machine or communication functions. Braking controller 250 may include all the components required to run an application such as, for example, a memory, a secondary storage device, and a processor, such as a central processing unit or any other means known. Various other known circuits may be associated with braking controller 250, including power source circuitry (not shown) and other appropriate circuitry.

Braking controller 250 may be configured to initiate or increase a braking force of braking system 260 associated with train 100. However, receiver 160 may receive an override signal from an operator of train 100 indicative of a command to ignore the collision threat identified by receiver 160. If receiver 160 receives an override signal, braking controller 250 may be configured to leave the braking force unchanged.

Figure 3:
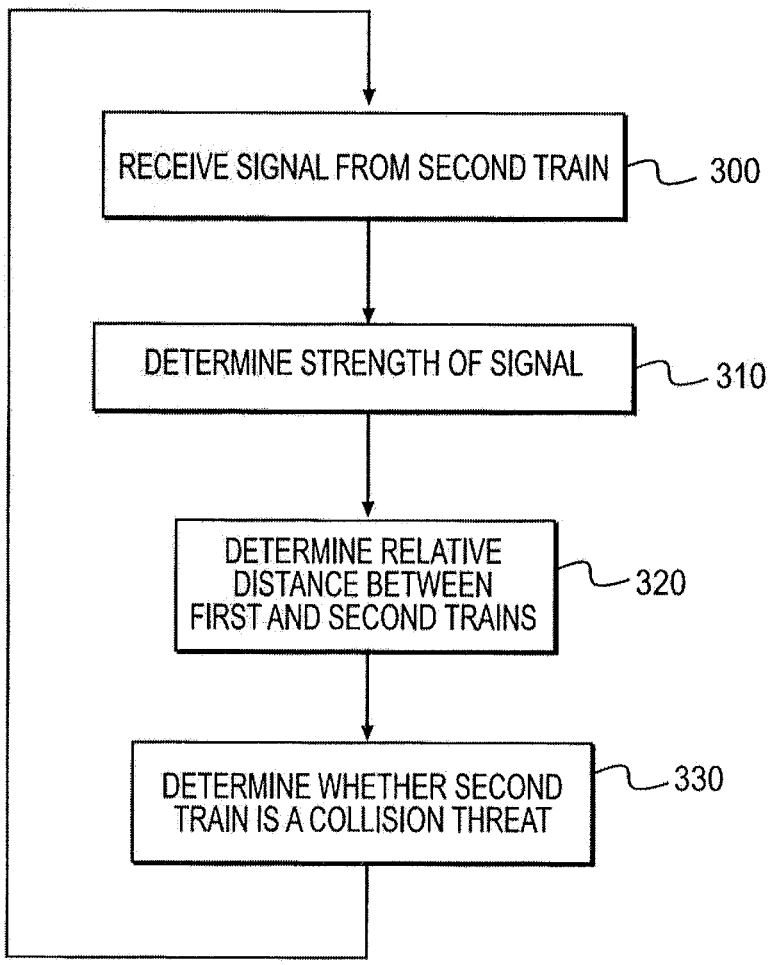
FIG. 3 is a flowchart of an exemplary embodiment of a method for detecting collision threats.

FIG. 3 is a flowchart of an exemplary embodiment of a method that receiver 160 may use to detect collision threats. At step 300, receiving a remote signal 210 from second train 220 may serve to initialize the method. Receiver 160 determines the strength of remote signal 210 at step 310. Based on the signal strength, receiver 160 determines the relative distance between first train 100 and second train 220 based on signal strength. As discussed above, this determination can use a lookup table and/or an algorithm to determine the relative distance within a suitable margin of error at step 320.

At step 330, receiver 160 determines whether train 220 is a collision threat to train 100. This may be at least partly based on the relative distance of train 220 from receiver 160. Evaluating the threat at step 330 may optionally include considering the relative speed and/or direction trains 220 and 100. Additionally or alternatively, evaluating the threat may be based on track warrants and occupation.

Optionally, the method may also include receiving a second remote signal from train 220 and determining a second signal strength of the second remote signal. This information may be used to determine the relative speed of train 220 based on the amount of time between receiving the signal and the second signal from train 220. Receiver 160 may at least partially rely on this information at step 330 to determine whether train 220 is a collision threat. Furthermore, this information may be used to determine the travel direction of train 220 based on its relative speed and the second signal strength. For example, if the second signal strength is less than first signal strength, train 220 may be moving away from receiver 160. The direction of travel of train 220 may also be considered when determining whether train 220 is a collision threat.

The method may optionally include identifying an occupied track. The occupied track may be the track on which train 100 associated with receiver 160 is traveling. Receiver 160 may be configured to determine which track train 220 is traveling on. For example, receiver 160 may receive a signal from transmitter 230 indicative of the track on which second train 220 is traveling. Receiver 160 may compare the identity of the occupied track and the track used by second train 220 to determine whether second train 220 is a collision threat.

As receiver 160 may be used to receive signals from transmitter 150 associated with the same train 100 in addition to receiving remote signals from other trains 220, receiver 160 may identify a home train. This identification may use a serial code embedded in EOT signal 200, and possibly serial codes embedded in remote signals 210. Receiver 160 may compare the serial codes to a stored serial code indicative of train 100 to determine whether a particular signal was sent from transmitter 150 or another transmitter 230 associated with a second train 220.

Even if train 100 and second train 220 are not traveling on the same track, receiver 160 is configured to notify the dispatch that it anticipates that the two trains 100 and 220 will pass one another on different tracks. For example, receiver 160 may determine that second train 220 is approaching on a second track based on the relative distance between receiver 160 and train 220. Based on the relative distance between and relative speeds of trains 100 and 220, receiver 160 may determine that the two trains 100 and 220 will pass one another. Receiver 160 may also determine an approximate time at which trains 100 and 220 will pass one another. According to some embodiments, receiver 160 may be configured to transmit this data to dispatch and/or train operator.

INDUSTRIAL APPLICABILITY

The disclosed systems and methods may provide a solution for detecting potential rail collisions. As a result, trains that incorporate the disclosed systems and methods may decrease the likelihood that they will be involved in rail collisions and decrease the severity of any rail collisions that may occur, as the trains may be able to sooner detect and react to a possible collision threat.

The presently disclosed systems and methods may have several advantages. First, the detection system does not require that each train communicate with a centralized communication system in order to detect collision threats. By eliminating the need to communicate with a centralized communication system to receive any third-party information, trains may be able to communicate with each other directly to detect and avoid collision threats. This decentralized system may be implemented without the high infrastructure costs associated with other systems proposed for providing positive train control.

Additionally, the detection system may use subsystems that may already be present on locomotives, such as, for example, EOT technology. For example, the same receiver and transmitter used for LOT systems, with a few minor modifications, may be modified to serve the dual purposes of collision avoidance and EOT monitoring.

Furthermore, the disclosed systems and methods may provide a reliable solution for detecting other trains in the vicinity without requiring knowledge of the rail topology. For example, the same embodiments may be configured to detect collision threats without requiring any preloaded maps or GPS technology to determine whether a sensed train is a collision threat. Instead, this determination can be made simply from information acquired from the signals emitted by transmitters associated with the trains.

It will be apparent to those skilled in the art that various modifications and variations can be made to the disclosed rail collision threat detection system and associated methods for operating the same. Other embodiments of the present disclosure will be apparent to those skilled in the art from consideration of the specification and practice of the present disclosure. It is intended that the specification and examples be considered as exemplary only, with a true scope of the present disclosure being indicated by the following claims and their equivalents.

What is claimed is:

1. A detection system comprising:

a transmitter associated with a first train and configured to emit an end-of-train signal; and a receiver associated with the transmitter and the first train and configured to:

receive the end-of-train signal from the transmitter;

receive at least one remote signal from a second train;

detect a signal strength of the remote signal;

determine a relative distance of the second train from the first train based on the signal strength of the remote signal; and determine whether the second train is a collision threat to the first train based on the remote signal from the second train.

2. The detection system of claim 1, wherein a communication frequency at which the receiver is configured to receive signals is the same frequency used by both the first and second train for end-of-train communications.

3. The detection system of claim 1, wherein the remote signal comprises an end-of-train signal from a second transmitter associated with the second train.

4. The detection system of claim 3, wherein the remote signal further includes a track identifier, and the receiver is configured to determine whether the second train is a collision threat based on the track identifier and a track on which the first train is located.

5. The detection system of claim 1, wherein the receiver is configured to:

determine whether the second train is within a warning range of the receiver; and in the event the second train is within the warning range, identify the collision threat based on the relative distance and the speed of the second train.

6. The detection system of claim 5, further including:

a warning system configured to notify at least one of a dispatch and a train operator of the collision threat; and a braking controller configured to initiate a braking force of the first train.

7. A method for detecting a collision threat between a first train and a second train comprising:

receiving on the first train a signal from the second train;

detecting a signal strength of the signal;

determining a relative distance between the first train and the second train based on the signal strength; and identifying whether the second train is a collision threat to the first train based on the relative distance.

8. The method of claim 7, further including:

notifying at least one of a dispatch and an operator of the first train of the collision threat; and sending a command to initiate a braking force of the first train.

9. The method of claim 8, further including identifying an occupied track, wherein the signal is indicative of a track on which the first train is travelling and identifying whether the second train is a collision threat is further based on whether the track on which the second train is travelling is the same as the occupied track.

10. The method of claim 9, further including:

identifying a home train; and determining whether the signal is received from the home train, wherein the signal is indicative of a train identifier.

11. The method of claim 9, further including:

determining the second train is approaching on a second track based on the relative distance;

determine a time at which the home train and the train will pass based on the relative distance and the relative speed; and notifying the dispatch that the second train and the home train will pass one another.

12. The method of claim 7, further including:

receiving a second signal from the second train;

detecting a second signal strength of the second signal; and determining a relative speed of the second train based on a time between receiving the first and second signals and the difference between the first and second signal strength, wherein identifying whether the second train is a collision threat is further based on the relative speed of the second train.

13. The method of claim 12, further including determining a travel direction of the second train based on the relative speed of the second train and the second signal strength, wherein identifying whether the second train is a collision threat is further based on the travel direction of the second train.

14. A first train comprising:

a locomotive;

a transmitter associated with at least one of the locomotive and a trailing railcar and configured to emit an end-of-train signal; and a receiver associated with the locomotive and configured to:

receive the end-of-train signal from the transmitter;

receive a remote signal from a second train;

detect a signal strength of the remote signal;

determine a relative distance of the second train from the first train based on the signal strength of the remote signal; and determine whether the second train poses a collision threat to the first train based on the remote signal.

15. The first train of claim 14, wherein a communication frequency at which the receiver is configured to receive signals is the same frequency used by both the first and second train for end-of-train communications.

16. The first train of claim 14, wherein the remote signal comprises an end-of-train signal from a second transmitter associated with the second train.

17. The first train of claim 16, wherein the second signal further includes a track identifier, and the receiver is configured to determine whether the second train is a collision threat based on the track identifier and a track on which the second train is travelling.

18. The train of claim 14, wherein the receiver is configured to:

receive a second remote signal from the second train;

detecting a second signal strength of the second remote signal; and determine a travel direction of the second train based on the relative speed of the second train and the second signal strength.

* * * * *